US007033284B2

(12) United States Patent
Yoshimura

(10) Patent No.: US 7,033,284 B2
(45) Date of Patent: Apr. 25, 2006

(54) STROKE CORRECTING DEVICE AND STROKE CORRECTING METHOD

(76) Inventor: Kaneya Yoshimura, 1424, Kamigyutoku, Gamo-cho, Aira-gun, Kagoshima (JP)

( * ) Notice: Subject to any disclaimer, the term of this patent is extended or adjusted under 35 U.S.C. 154(b) by 0 days.

(21) Appl. No.: 10/466,269

(22) PCT Filed: Jan. 10, 2002

(86) PCT No.: PCT/JP02/00104

§ 371 (c)(1),
(2), (4) Date: Oct. 15, 2003

(87) PCT Pub. No.: WO02/055159

PCT Pub. Date: Jul. 18, 2002

(65) Prior Publication Data

US 2004/0082400 A1 Apr. 29, 2004

(30) Foreign Application Priority Data

Jan. 16, 2001 (JP) ..... 2001-007517

(51) Int. Cl.
*A63B 69/36* (2006.01)

(52) U.S. Cl. ..... 473/276; 473/212; 473/227

(58) Field of Classification Search ..... 473/212–219, 473/226–227, 271–277; 273/DIG. 30; 482/67, 482/95, 105, 109

See application file for complete search history.

(56) References Cited

U.S. PATENT DOCUMENTS

| | | | | | |
|---|---|---|---|---|---|
| 5,156,401 | A | * | 10/1992 | Hodgkiss | 473/227 |
| 5,203,568 | A | * | 4/1993 | Vasquez | 473/212 |
| 5,248,146 | A | * | 9/1993 | Viets et al. | 473/206 |
| 5,259,621 | A | * | 11/1993 | Keefer | 473/212 |
| 5,470,073 | A | * | 11/1995 | Vasquez | 473/206 |
| 5,904,624 | A | | 5/1999 | Martinez | |
| 6,358,156 | B1 | * | 3/2002 | Moran | 473/219 |
| 6,805,640 | B1 | * | 10/2004 | Kim et al. | 473/226 |

FOREIGN PATENT DOCUMENTS

| | | |
|---|---|---|
| JP | 10-248985 A | 9/1998 |
| JP | 11-57078 A | 3/1999 |

* cited by examiner

*Primary Examiner*—Gregory Vidovich
*Assistant Examiner*—Nini F. Legesse
(74) *Attorney, Agent, or Firm*—Birch, Stewart, Kolasch & Birch, LLP

(57) ABSTRACT

A stroke correcting device which includes an arm device having arm pads attached thereto and a golf club fixing device for fixing a putter or an iron golf club Thereto, wherein the arm device has the function of adjusting the distance between right and left arms, the function of adjusting a positional relation between right and left arms, the function of adjusting an angle in the arm device, the function of adjusting the angle formed by the arm device and the golf club fixing device and the function of adjusting the angle formed by the arm device and the golf club.

8 Claims, 7 Drawing Sheets

STROKE CORRECTING DEVICE AND STROKE CORRECTING METHOD

This application is the national phase under 35 U.S.C. § 371 of PCT International Application No. PCT/02/00104 which has an International filing date of Jan. 10, 2002, which designated the United States of America.

TECHNICAL FIELD

The present invention relates to an approach/putting golf stroke correcting device and an approach/putting golf stroke correcting method with the function of improving approach shots and the putting stroke.

BACKGROUND ART

Under conventional putting practice methods, it could occur that respective forces of the right and left arms are not well balanced, the arms and wrists are improperly loosened at impact, the hitting face of a putter is incorrectly angled, or the putting stroke deviates from its intended direction, resulting in the fact that the putting stroke is not easily improved. In addition, an intense eagerness to try to put the ball into the cup causes the body to move abnormally.

Effective training devices or methods for correcting the above described defects, however, have been few. For example, Japanese Patent Laying-Open No. 11-57078 discloses a structure of a putter with an aim to improve the golf score and Japanese Patent Laying-Open No. 10-2985 discloses a training device for improving putting. There remains the problems, however, that the former does not solve the problem of improper looseness of the arms and wrists and the latter provides training which is done on a certain flat place, provides a training method through which a player in training has to move in conformity with the movement of the device, does not allow the player to take any positioning that the player likes, and exhibits poor portability.

Putting plays a considerable role in improving the golf score. Therefore, as players advance in skill, the putting becomes more important. The skill, however, cannot successively be conveyed orally since, positioning differs from player to player. Moreover, even if a player believes that he has learned the skill of the putting stroke after having practiced golf on a flat mat, for example the player still has difficulty in repeating an accurate putting stroke due to the undulations of an actual green.

It is an object of the present invention to allow putting to be practiced while overcoming various problems as described above. Specifically, an object of the present invention is to provide an approach/putting stroke correcting device and an approach/putting stroke correcting method wherein practice an be done not only on an open space and a golf practice range but also on an actual green or some area around the green of a golf course.

Another object of the present invention is to provide an approach/putting stroke correcting device and an approach/putting stroke correcting method that can be appropriately adapted to a practice menu and can be precisely adjusted by minimum adjustment since the portion to be adjusted can be accurately recognized.

Still another object of the present invention is to provide an approach/putting stroke correcting device an approach/putting stroke correcting method that can readily be utilized by players of all aged as well as amateur and professional golfers.

A further object of the present invention is to provide an approach/putting stroke correcting device and an approach/putting stroke correcting method that can be carried to the practice field where strokes can be practiced properly at any place the practice field so as to allow a player to acquire a sense of correct a stroke through repeated practice.

DISCLOSURE OF THE INVENTION

The inventor of the present invention has developed a stroke correcting device and a stroke correcting method whereby a player in training (who practices strokes) is not required to adapt to a machine or device but practices strokes appropriately for the player by adjusting the device according to the physique, posture and the like of the player, so that the player can develop a sensitivity by him/herself, acquire sense of correct a stroke and thus learn a correct putting stroke or approach stroke.

The stroke correcting device according to the present invention is a device whereby an approach or putting stroke can accurately and stably be made, namely, a device used for improving an approach shot or a putting stroke.

The stroke correcting device a of the present invention is held softly while in use and at an appropriate time is held in the chest and arms of a player in such a manner that the device is brought into close contact with the player, or the device can be readily removed . Moreover, the correcting device can be appropriately adjusted according to the physique of the player or a practice menu.

A specific structure of the present invention with the purpose of achieving the above objects is hereinafter described.

According to the present invention, an approach or putting stroke correcting device includes an arm device having a plurality of arm pads (arm covers) attached thereto for supporting the arms of a player and includes a golf club fixing device. The arm device and the golf club fixing device are fixed. Further, the golf club fixing device is used for fixing a putter golf club or an iron golf club to the arm device.

The approach/putting stroke correcting device may be substantially a pentagon in shape when the arm device is in position. The arm device may include an elbow-to-elbow distance adjusting component attached thereto that has a reinforcing function and is capable of fine-adjusting the distance between right and left elbows of the player.

Preferably, the stroke correcting device of the present invention can adjust the distance between the right and left arms of the player, adjust the respective lengths of components according to the positional relationship between the right and left arms of the player, adjust the angle in the arm device, adjust the angle formed by the arm device and the golf club fixing device and adjust the angle formed by the arm device and a utter or iron golf club.

The arm device includes a frame which extends along and is in contact with the upper arms of the player (hereinafter abbreviated as "upper-arm frame" upper-arm edge) and a frame which extends along and is in contact with forearms (hereinafter abbreviated as "forearm frame": forearm edge). In this case, the arm device includes forward-tilt angle adjusting screw and a slide wide hole for adjusting the. forward-tilt angle (β) of a coupling portion between the upper-arm frame and the forearm frame and adjusting respective lengths of components along the arms of the player according to respective lengths of the right and left arms.

In other words, the stroke correcting device may include the forward tilt angle adjusting screw and the slide guide hole that can adjust the forward-tilt angle and lengths of components corresponding to the right and left arms.

The arm pads may include an arm portion having a hollow or concave portion extending from the upper arm to the forearm of the player and receiving the upper arm and the forearm, and the arm portion may include an upper-arm portion which extends along the upper arm of the player, a forearm portion along the forearm of the player and a bent portion between the upper-arm portion and the forearm portion. In this case, the bent portion can be variably adjusted.

In other words, the stroke correcting device may include a component, instead of the upper-arm frame and the forearm frame of the arm device having arm pads attached thereto, that is shaped for example into a longitudinally halved human arm and has the bending portion which can be variably adjusted and includes the golf club fixing device.

The upper arms of the player are brought into close contact with the upper-arm arm pads and the forearms of the player are brought into close contact with the forearm arm pads and the stroke correcting device is adjusted in such a manner that the stroke correcting device is integrated with a putter or iron club to allow the player to take a desired position. In this state, the player makes an approach shot or putting stroke. More specifically, the player executes an approach or putting stroke white forming a pentagon between the right and left arms and the chest and maintaining the pentagon thus formed. In this way, the approach or putting stroke can be corrected.

Using the stroke correcting device of the present invention, the upper arms are brought into close contact with the upper-arm arm pads and the forearms are brought into close contact with the forearm arm pads, the distance between the right and left arms is adjusted, respective lengths of components are adjusted according to a positional relation between the right and left, the respective angles of components in the arm device are adjusted, the angle formed by the arm device and the golf club fixing device is adjusted, and the angle formed by the arm device a putter is adjusted. Then, the player executes an approach or putting stroke in the state that the stroke correcting device is integrated with the putter or iron club so that the player can assume a desired positioning. The approach or putting stroke can thus be corrected.

The arm device of the present invention is typically formed of five frames, i.e. a frame which is in contact with the chest (hereinafter chest frame), a set of upper-arm frames and a set of forearm frames. These frames are successively coupled to each other. The arm device of the present invention may be the one having a shape of longitudinally halved human arms instead of the upper-arm frames and the forearm frames and having a bending portion which can be variably adjusted. Lower ends of the forearm frames are coupled to a short metal fitting for example. To the metal fitting, the golf club fixing device is attached. A putter or iron club can be fixed at both longitudinal ends of the golf club fixing device. Accordingly, the arm device, the golf club fixing device and the putter or iron club are integrated into one unit.

The frames of the arm device are each made of bamboo, wood, such a metal as aluminum, titanium or stainless, or plastic, and have across section in the shape of a triangle, tetragon, pentagon, hexagon, octagon, circle, or ellipse, or angular U-shaped, L-shaped or hemispherical. for example.

The arm device may be structured as one component or foamed of two symmetrical components. Each frame may be straight or curve. The chest frame may be an arc of a circle, arc of an ellipse or straight in shape. Preferably, the chest frame in use is disposed at a predetermined distance from the chest of the player and is straight in shape.

The strength of the arm device could be deteriorated due to a material of the frame or due to a reduced weight of the material. Then, for reinforcement of the arm device or for adjustment of distance the between right and left elbows, an elbow-to-elbow distance adjusting component may further be attached.

The length of the upper-arm frames can be adjusted according to the length of the upper arms. Similarly, the length of the forearm frames can be adjusted according to the length of the forearms. In particular, the length of the upper-arm frames can be fine-adjusted since the positions of the right arm and the left arm are different in terms of the vertical direction depending on the state of gripping. However, it is not particularly required that the length of the forearm frames can lie adjusted. The lengths are adjusted by screw-fastening, tripod sliding, screwing or the like.

For a coupling portion between the upper-arm frames and the forearm frames, an angle between the upper-arm frames and the forearm frames can be adjusted to a desired angle. This angle. is referred to as the "forward-tilt angle."

Arm pads are attached respectively to the upper-arm frames arid the forearm frames. Through these arm pads, the upper arms and the forearms are brought into close contact with the frames. The arm pads of the forearm frames can be moved up and down to make an adjustment in such a way that the forearms are in close contact with the arm pads. In this way, the right and left arms and the arm pads can be fixed in a well balanced state without displacement therebetween. The arm pads are for example semicylindrical in shape. Although the arms may be fixed to the frames by the arm pads, it is not necessarily required that the arms are fixed to the frames. Rather, it is preferred that the arms can freely be attached/detached to/from the arm device.

The length of each frame and the forward-tilt angle are adjusted so that an ideal pentagon for putting can be formed between the right and left arms and the chest.

The golf club fixing device of the present invention includes, for example, a fitting for the upper part of the grip of a putter or iron golf club, a fixing screw for the upper part of the grip of the putter or iron golf club, a fixing arm for the putter or iron golf club, a fixing arm screw for the putter or iron golf club and a metal coupling fitting for the forearm frames and the golf club fixing device. The metal coupling fitting has a screw attached thereto for adjusting the angle between the forearm frames and the putter. This angle is referred to as "putting (stroke) forward-tilt angle." This angle is adjusted according to the size of the palm, the thickness and length of the fingers, the state of gripping, or the forward-tilt of the posture of the player when the sole of the putter is positioned on the ground. Adjustment of the angle as mentioned above is made by a wing screw, screw driver, screw using a coin. Preferably, screws adjustable by mark coins are used.

The length of the fixing arm for the putter or iron golf dub is not greater than that of the grip of the putter or iron golf club. The fixing arm 15 is curbed in shape so as not to obstruct gripping by the player.

It is thus seen from the above that the approach or putting stroke correcting device of the present invention can be used regardless of whether the player is right-handed or left-handed.

According to a stroke correcting method of the present invention, a stroke is executed in a state in which arms of a player in training are supported on arm pads and a golf club and the arm pads are integrated into one unit so as to allow the player to take a positioning which the player desires to take.

A method of correcting an approach or putting stroke using the 25 stroke correcting device of the present invention is hereinafter described.

The arm device, the golf club fixing device and a putter or, iron club are assembled roughly to form a certain shape in advance. In the following, correction of the putting stroke is described.

First, a golf ball i placed on a flat mat or green and, a posture, a positioning and an address are determined according to a practice menu which the player desires to follow or according to suggestions of an instructor. The assembled correcting device is held in the right hand and the chest frame is pressed lightly against the chest while the arm pads attached to the left upper-arm frame and left forearm frame are brought into close contact with the left arm. The hitting face of the putter is directed perpendicularly to a putt line. A positioning is taken to tilt the body forward so that the left eye can see the golf ball below the eye. In this state, the arm device is fixed to the right arm and the distance between the right and left arms (chest width), the distance between the right and left elbows, the length of each frame, the forward-tilt angle and the putting forward-tilt angle are adjusted. Consequently, the posture, positioning and address of the player can uniformly be determined. Then, the player executes a stroke along the putt line.

The direction of the ball and the distance the ball flies cap be known through take-back and follow-through. The player thus repeats practice including the above steps to physically acquire a sense of the putting stroke. Then, the player makes a desired putting stroke without the stroke correcting device to confirm that the player can execute the correct putting stroke which the player has learned.

Through a procedure similar to the above-described one, the player repeatedly practices putting by means of the stroke correcting device on an actual green with undulations. Executing a correct putting stroke, the player can set a virtual putt line or read a putt line When such a putt like an approach putt from a somewhat long is distance is executed, a large take-back has to be made. Then, it could occur that the body shifts considerably from a proper posture which is accompanied by an abnormal sense to correct the shift. Then, the stroke correcting device of the present invention can be used to physically acquire a sense of a correct putting stroke. In this way, the player executing practice repeatedly by means of the stroke correcting device of the present invention can induce the players own sensitivity and consequently make a correct putting stroke Moreover, the stroke for an approach shot by an iron club can be also corrected. The present invention is effective as a method for correcting strokes of a pitch shot, a pitch-and-run, a running approach shot around a green for example within 50 yards, preferably within 30 yards from a hole.

Specifically, players positions a golf ball and determines the posture, the positioning and the address based on a practice menu which the player desires to follow or suggestions of an instructor. The player directs the face of an, iron perpendicularly to a shot line. In this state, the player adjust a the distance between the right and left arms, the distance between the right and left elbows, the length of each frame, the forward-tilt angle and the stroke forward-tilt angle of the correcting device. Accordingly, a posture, a positioning and an address of the player can uniformly be determined. The player then executes a stroke along the shot line. Through take-back and follow-through, the player knows the direction of the ball, the carry and the running distance. The player practices strokes repeatedly including the above steps to physically acquire a sense of a stroke of an approach shot. Next, the player executes a desired stroke of an approach shot without using the stroke correcting device so as to confirm that the player can make the learned correct stroke of the approach shot.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

BEST MODES FOR CARRYING OUT THE INVENTION

For understanding of an approach or putting stroke correcting device according to the present invention, embodiments are specifically described in connection with the drawings, while the present invention is not limited to these embodiments.

Figure 1:
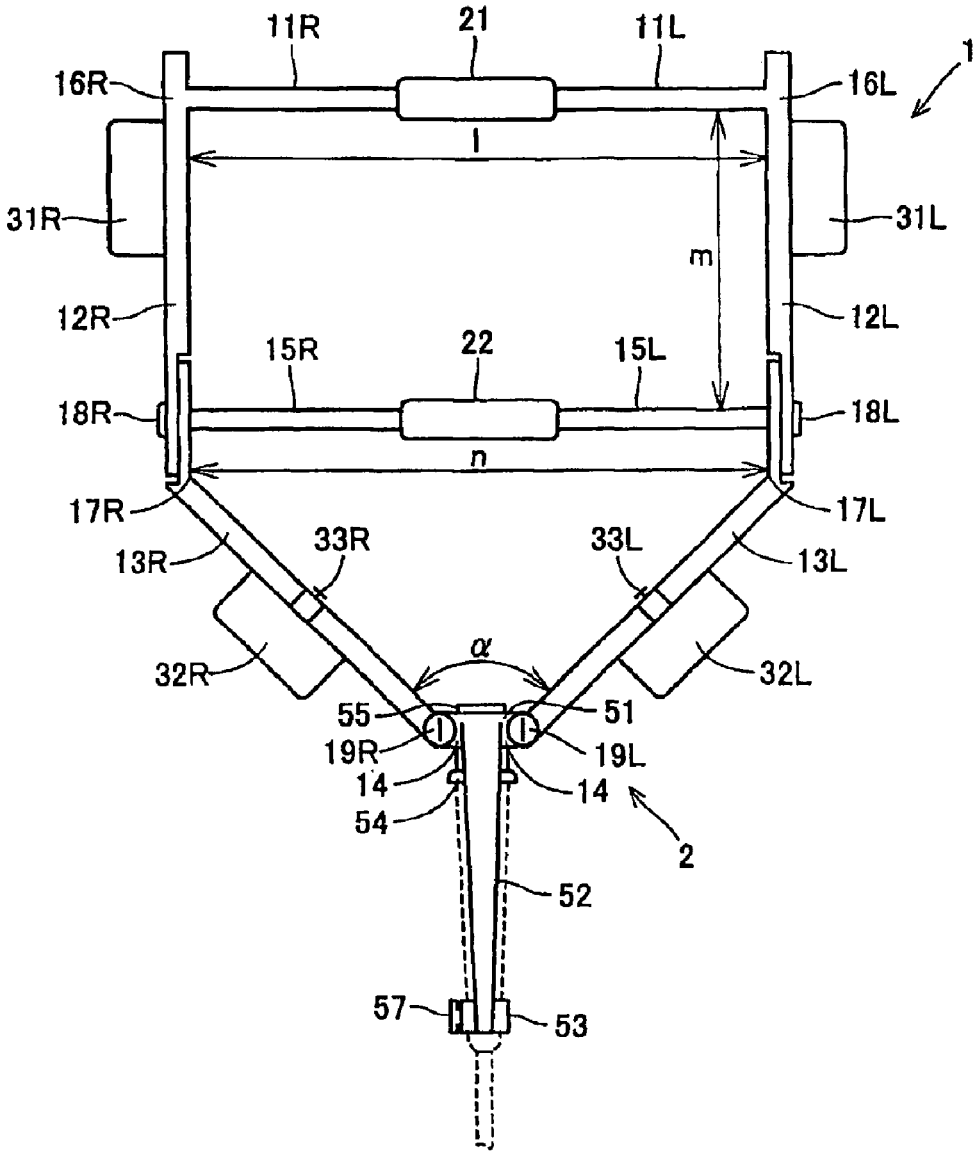
FIG. 1 is a front view of a stroke correcting device according to the present invention.
Figure 2:
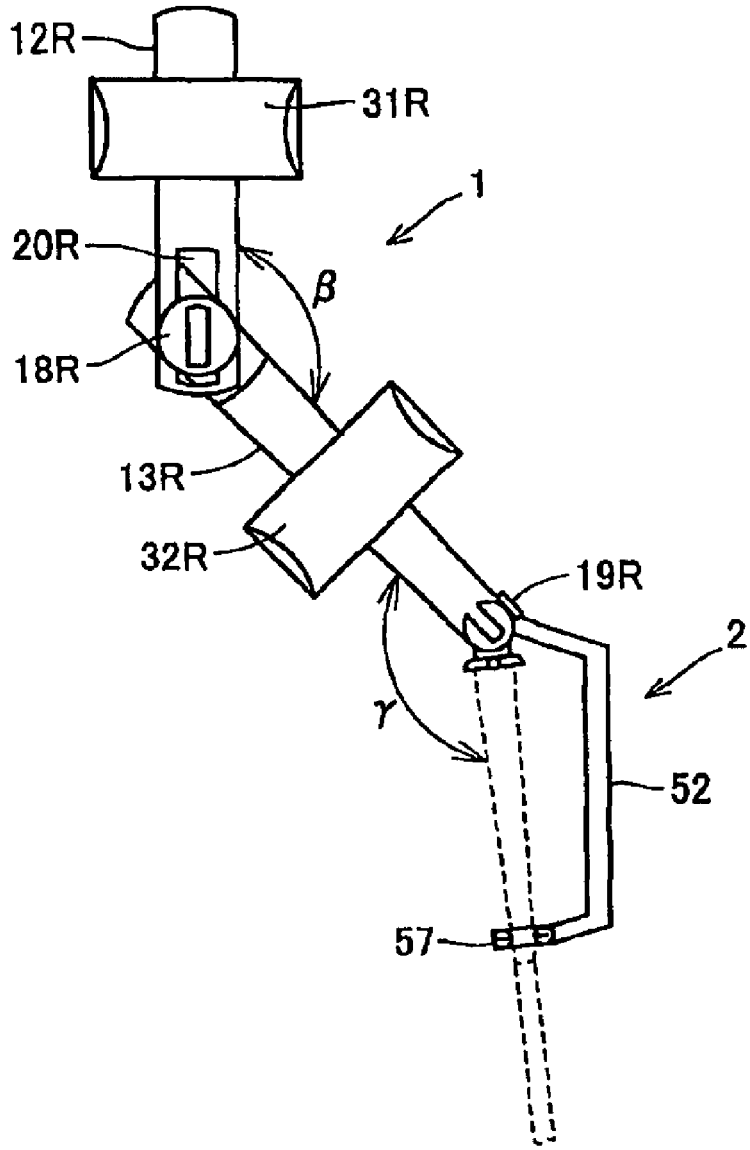
FIG. 2 is a side view of the stroke correcting device according to the present invention.
Figure 3:
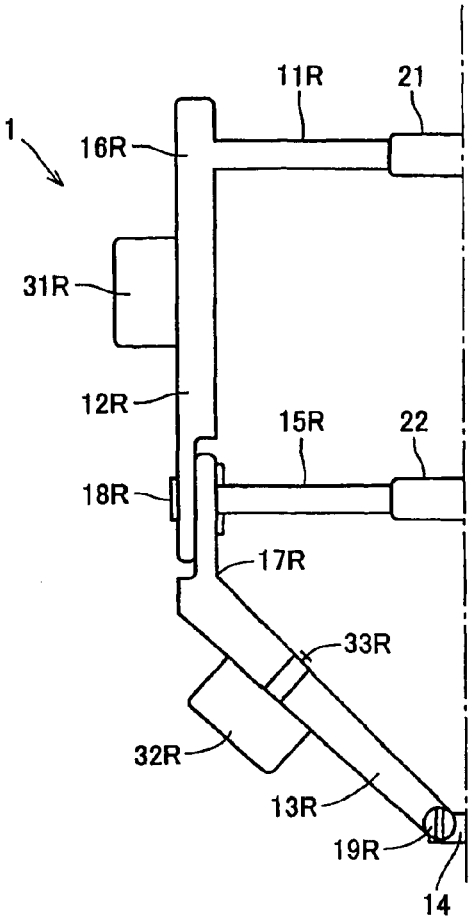
FIG. 3 is a front view of the right side of an arm device according to the present invention.
Figure 4:
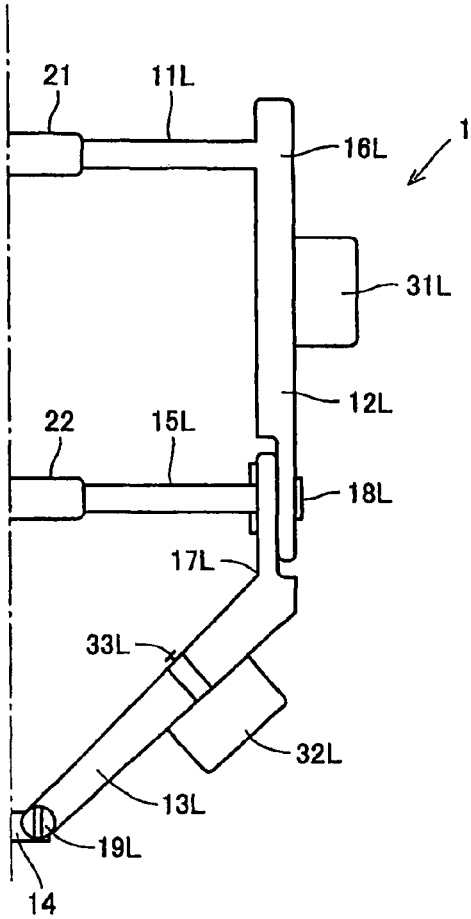
FIG. 4 is a front view of the left side of the arm device according to the present invention.

FIGS. 1 and 2 show an approach or putting stroke correcting device of the present invention that has one elbow-to-elbow distance adjusting component. The stroke correcting device has an arm device (I, FIGS. 1, 3 and 4) to which arm pads (31R, 31L, FIG. 1) are attached and has a golf club fixing device (2, FIGS. 1, 7, 8 and 9).

Arm device (1) may be structured as one component or formed of two symmetrical components. Each frame (edge) may be straight or curved. A chest frame may be an arc of a circle, an arc of an ellipse or straight in shape for example. Preferably, the chest frame is straight.

Arm device (1) is formed of five frames that are a chest frame (11R, 11L, 21), upper-arm frames (12R, 12L) and forearm frames (13R, 13L). Ends of these frames are coupled successively to each other.

Figure 5:
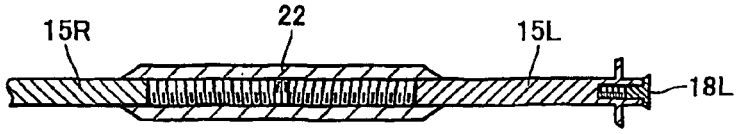
FIG. 5 is an enlarged cross-sectional view of an elbow-to-elbow distance adjusting component according to the present invention.
Figure 6:
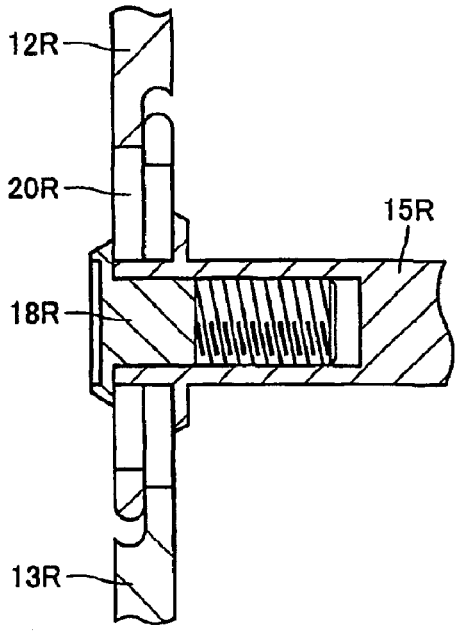
FIG. 6 is an enlarged cross-sectional view of a forward-tilt angle, adjusting screw and a slide guide hole of an arm according to the present invention.
Figure 7:
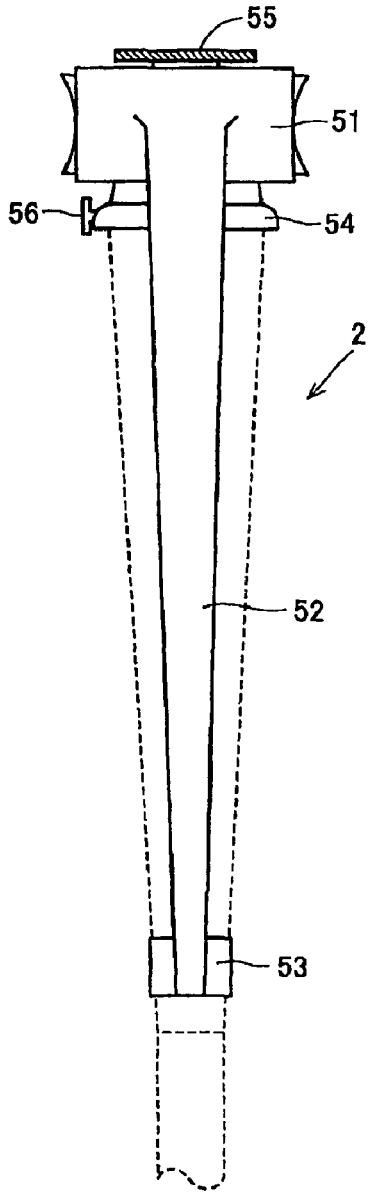
FIG. 7 is a front view of a golf club fixing device according to the present invention.
Figure 8:
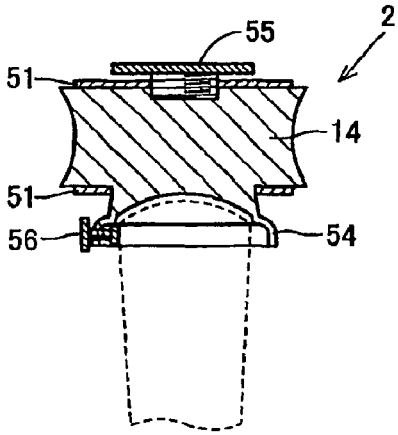
FIG. 8 is a partial cross-sectional view of the golf club fixing device according to the present invention.
Figure 9:
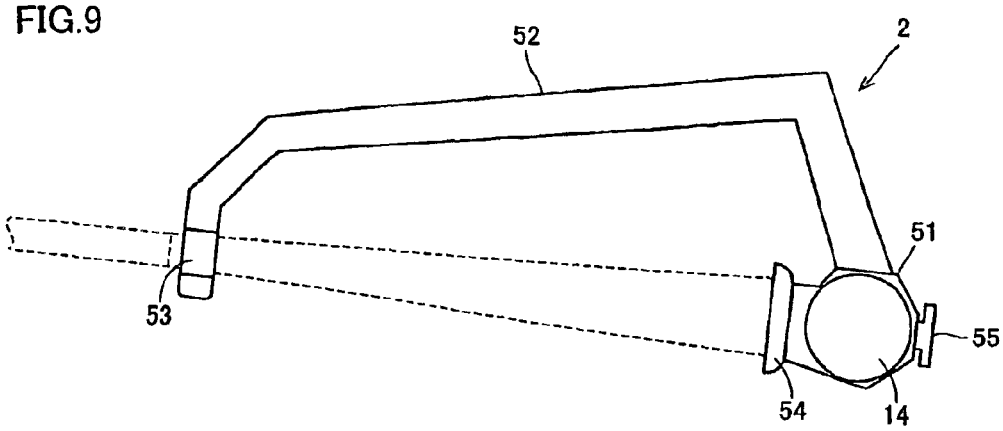
FIG. 9 is a side view of the golf club fixing device according to the present invention.

Lower ends of respective forearm frames are coupled to a short metal fitting (14). For reinforcement of each frame that is required due to a material of the frame or due to a reduced weight of the material, or for adjustment of a distance between elbows, an elbow-to-elbow distance adjusting component (15R, 15L, 22, FIG. 5) is further attached. Coupling portions (16R, 16L) between the chest frame and upper-arm frames may be formed integrally, however, it is preferable to couple the frames to each other by screws. The elbow-to-elbow adjusting component is attached to 10 coupling portions (17R, 17L, FIG. 6) between upper-arm frames end forearm frames, and the coupling portions include adjusting portions (20R, 20L) for adjusting the length of the upper-arm frames and adjusting straws (18R, 18L, FIG. 6) for adjusting a forward-tilt angle.

The frames of arm device (1) are each made of bamboo, wood, such a 15 metal as aluminum, titanium or stainless, or plastic, and have a cross section in the shape of a triangle, tetragon, pentagon, hexagon, octagon or circle, or angular U-shaped or L-shaped. The chest frame is preferably formed of aluminum pipes (11R, 11L) having threaded ends and an adjusting screw (21).

Upper-arm frames (12R, 12L) are preferably formed each of a wooden or aluminum plate having a width of 105–125 mm, a thickness of 105–125 mm and a length of 105–125 mm, and have, in their upper parts, respective holes for attachment of aluminum pipes (11R, 11L) aid slide guide holes (20) for attachment of forearm frames (13R, 13L) (see FIG. 2).

Preferably, the forearm frames are each formed of an aluminum pipe with its ends flattened and holes are made in the flattened ends. The upper portions of forearm frames (13R, 13L) are bent at an angle of 105125°.

An aluminum pipe is used for metal fitting (14) which had its ends 30 where slots are made, and the flattened ends of forearm frames (13R, 13L) can be inserted into the slots. The forearm frames and the meal fitting are coupled by screws (19R, 19L).

Elbow-to-elbow distance adjusting component (15R, 15L, 22, FIG. 5) includes aluminum pipes (15R, 15L) having threaded parts as well as an adjusting screw (22) similar to those of the chest frame. Arm pads (arm covers: 31R, 31L, 32R, 32L) are attached respectively to the upper-arm frames and the forearm frames.

Figure 12:
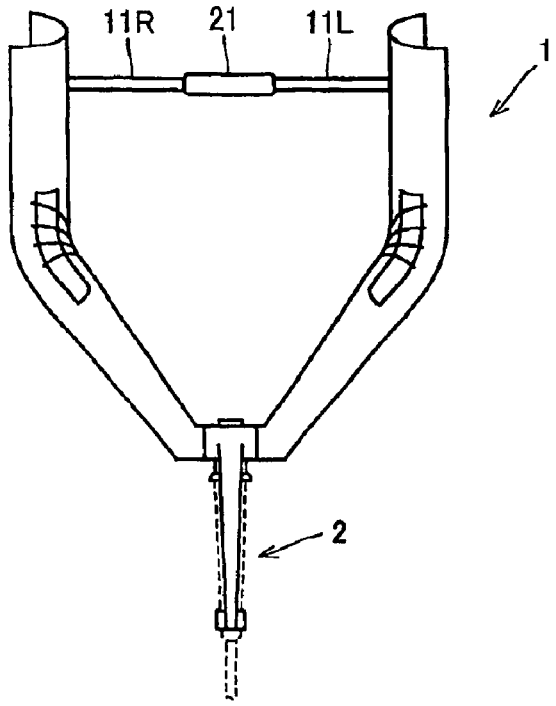
FIG. 12 is a schematic view of a stroke correcting device having an arm portion in the shape of longitudinally halved human arms.

An arm device (1) as shown in FIG. 12 may be used, instead of the one having the upper-arm frames and the forearm frames, that is in the shape of longitudinally halved human arms and has bent portions that are variably adjustable.

Upper arms and forearms are brought into close contact with respective frames via above-mentioned arm pads (31R, 31L, 32R, 32L). Arm pads (32R, 32L) of for arm frames (13R, 13L) are slidable up and down along forearm frames (13R, 13L) and adjusting screws (33R, 33L) are used to bring the forearms into close contact with the arm pads. In this way, the arms and arm pads are fixed in a well-balanced state without 15 displacement with respect to each other. Ann pads (31R, 31L, 32R, 32L) are semicylindrical in shape.

Although the arms may be fixed to arm device (1) by means of the arm pads as described above, it is not necessarily required that the arms are fixed to arm device (1). Depending on the player, it would be better that the arms can freely be moved.

The length "1" of the chest frame is adjusted by adjusting screw (21) so that the length conforms to the chest width of a player. The length "m" of upper-arm frames is adjusted by adjusting screws (18R, 18L) so that the length conforms to the length of the upper arms. After adjustment of the lengths "1" and "m," the forearm frames and metal fitting (14) are fixed by screws (19R, 19L). It is supposed here that the angle formed between the left and right forearm frames is a (see FIG. 1).

A desired forward-tilt angle a formed at the joints between the upper-arm frames and the forearm frames is adjusted by adjusting screws 30 (18R, 18L) (see FIG. 2). The length of each of the frames and the forward-tilt angle are thus adjusted to form, between the chest and the arms of the player in training, an ideal pentagon for putting.

Golf club fixing device (2, FIGS. 1, 7, 8 and 9) has a coupling portion (51) with metal fitting (14), a coupling screw (55), a putter fixing arm (52), a putter fixing arm screw (57), a lower putter grip fitting (53), an upper putter grip fitting (54), and an upper putter grip fixing screw (5G). By means of putter fixing arm screw (57) and upper putter grip fixing screw 5 (5G), the grip of a putter is fixed to arm device (1) (see FIG. 7). Coupling screw (55) is used to adjust an angle y formed between arm device (1) and the putter, namely a putting forward-tilt angle (see FIG. 2).

Figure 10:
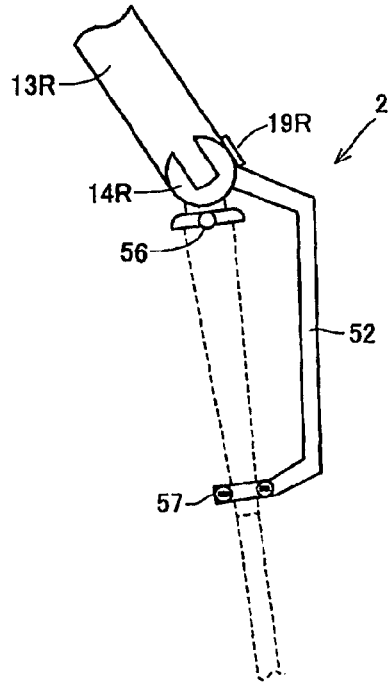
FIG. 10 is a side view of the golf club fixing device to which a putter is fixed according to the present invention.

Accordingly, arm device (1), golf club fixing device (2) and the putter are integrated into one unit as shown in FIG. 10. The grip of the putter is 10 indicated by dotted lines or dashed lines in FIGS. 7–10. An iron club can also be fixed to arm device (1) in a manner similar to that described above. Moreover, the device of the present invention can be used regardless of whether the player is right-handed or left-handed.

Figure 15:
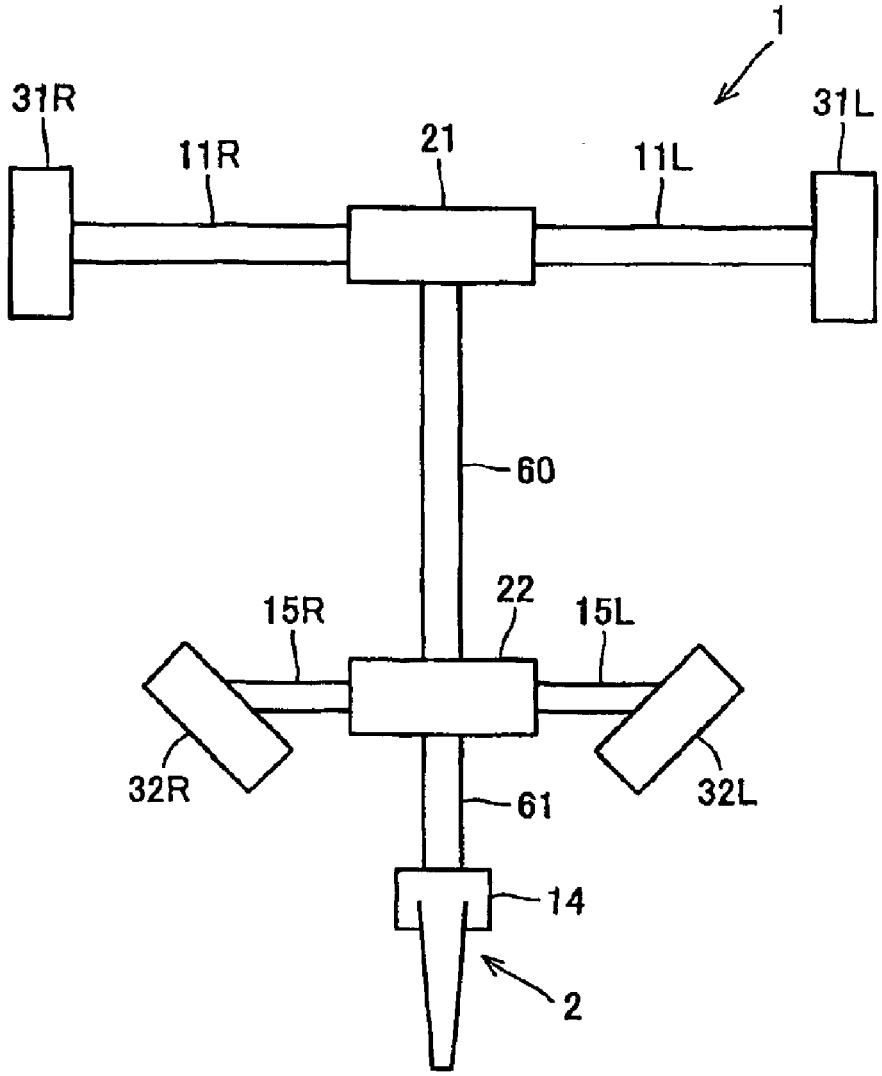
FIG. 15 is a front view of another stroke correcting device according to the present invention.

Another embodiment of the stroke correcting device shown in FIG. 15 is now described according to the present invention. As shown in FIG. 15, while upper-arm frames (12R, 12L) and forearm frames (13R, 13L) described above may be dispensed with, arm pads (31R, 31L) may be attached to respective ends of frames (11R, 11L) and arm pads (32R. 32L) may be attached to respective ends of frames (15R, 15L). Center frames 20 (60, G 1) for connecting each of the frames (11R, 11L, 15R, 15L) to golf club fixing device (2) are provided. In this case, arm device (1), golf club fixing device (2) and a golf club can also be fixed with an expectation that an effect similar to that of the device in FIG. 1 can also be achieved here.

Figure 13:
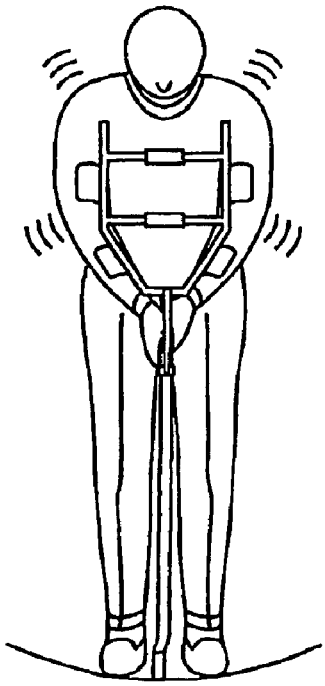
FIG. 13 shows that putting is practiced by means of the stroke correcting device of the present invention as seen from the front.
Figure 14:
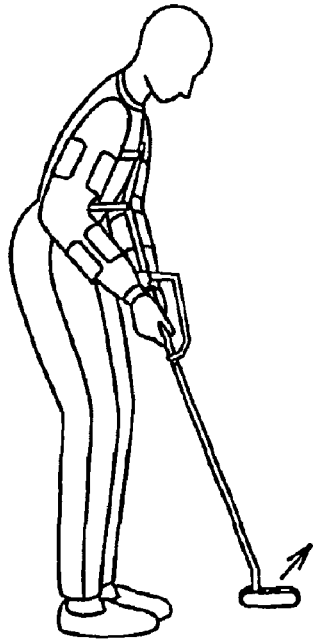
FIG. 14 shows that putting is practiced by means of the stroke correcting device of the present invention as seen from the side.

A putting stroke correcting method is now described. FIGS. 13 and 14 are respectively a front view and a side view of the stroke correcting device in use according to the present invention.

Arm device (1), golf club fixing device (2) and a putter or iron club are roughly assembled to form a certain shape in advance. First, a golf ball is placed on a flat mat or green and, a posture, a positioning and an 30 address are determined according to a practice menu that the player desires to follow or suggestions of an instructor. The assembled correcting device is held in the right hand and the chest frame (11R, 11L, 21) is pressed lightly against the chest while arm pads (31L, 32L) attached to left upper-arm frame (12L) and left forearm frame (13L) are brought into close contact with the left arm.

The hitting face of the putter is directed perpendicularly to a putt line. A positioning is taken in such a manner that a forward-tilt posture is 5 assumed to allow the left eye to seethe golf ball below the left ~eye. In this state, chest width "1" , elbow-to-elbow distance "n" and length "m" of the upper-arm frame are adjusted by adjusting screw (21), adjusting screw (22) stretchable slide guide hole (20) and adjusting screw (18L).

Then, adjusting screw (18R) is used to adjust upper-arm frame (12R) 10 and forearm frame (13R) thereby form an ideal pentagon for putting. This pentagon is a shape which is necessary for a putting operation and which is produced naturally when the putter is gripped correctly in both hands. Following this, forward-tilt angle β and putting forward-tilt angle y are adjusted which is shown in FIG. 2.

Figure 11:
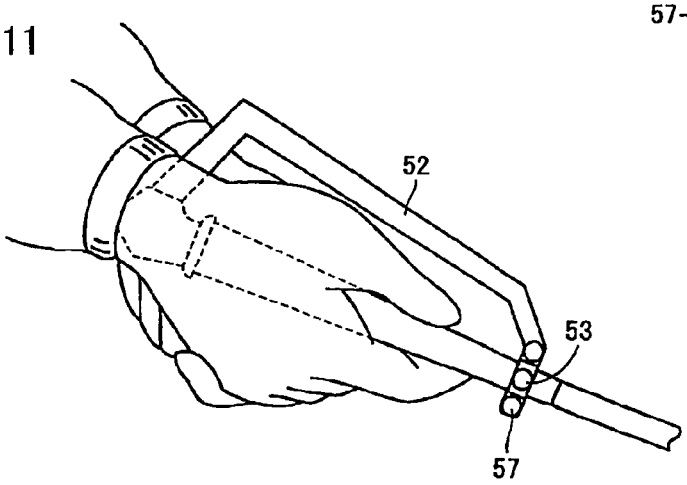
FIG. 11 is a schematic view of the golf club fixing device with a putter fixed thereto that is gripped according to the present invention.

Along the pentagonal shape, the upper arms and the forearms are brought into close contact with the arm pads of the right and left arms. If the forearms cannot be in dose contact with the arm pads, adjusting screws (33R, 33L) are used for adjustment so as to allow the forearms to be in close contact with the arm pads. FIG. 11 shows a state in which the butter is gripped.

Addressing is thereafter performed. Consequently, the posture, positioning and address of the player can uniformly be determined. With this state maintained, a stroke is made along the putt line. The direction and the distance the ball flies can be known through take-back and follow through. The player then repeats practice including the above steps to physically acquire a sense of the putting stroke.

Then, the player performs a desired putting stroke without the stroke correcting device to confirm that the player can make a correct putting stroke.

Through a procedure similar to the above-described one, butting can be corrected by means of the stroke correcting device on an actual. Green with undulations.

Further, through the similar procedure, a stroke of an approach shot by an iron club can be corrected by means of the stroke correcting device formed in the shape of a pentagon.

Strokes of a pitch shot, a pitch-and-run, a running approach shot around a green for example within 50 yards, preferably within 30 yards 5 from a hole can be corrected.

It is seen from the above that the stroke correcting device of the present invention is not the one like the conventional machine to which a player is fixed to learn a movement of the machine thereby correcting strokes. The stroke correcting device of the present invention is used to fix the posture of each player that is desirable and appropriate for the player and the player practices strokes while keeping this state so as to physically learn this desirable posture and can eventually make a desirable stroke.

The stroke correcting device of the present invention structured as described above accordingly achieves the following effects.

The stroke correcting device of the present invention is used in such a manner that a player softly holds the device in the arms to integrate the device and a puffer or iron into one unit. If the player applies an abnormal force to the device in making a stroke, the player receives a reaction force from the device. When the player relaxes the hold, the device could shift from the original position or separate from the arms. If any part of the body of the player makes an abnormal motion, that part receives a reaction force from the device.

Namely, the stroke correcting device which forms an ideal pentagon for putting can uniformly set a posture, a positioning and an address of a player in training. The pentagon is a shape which is necessary in doing an approach shot. If a putter or iron is correctly gripped in hands, the pentagon is consequently formed by the arms and chest.

In this way, the body of the player and the golf club are fired to form this ideal shape, the player maintains this state to execute a stroke and then adjusts the stroke so as not to receive any abnormal reaction force from the device while perceiving the sense of the player by him/herself. Such a practice as described above can be repeated to allow the player to acquire a correct stroke.

Once the player has acquired the correct stroke, the player is only required to consider the putt line and the distance while there is no need to check the posture and positioning each time the player makes a stroke. Thus, in executing a putting or approach shot, the player only checks such external factors as the grain of the grass, undulation and the strength of the wind and accordingly can concentrate on the ball.

Further, the player can sense a slight difference in feeling between the case in which the ball hits on the sweet spot of the face and the case in which the ball hits on another spot, and thus the player can smoothly address the ball.

Moreover, golfers can play golf rhythmically and at good tempo from a practice swing and an address to a stroke and thus increasingly enjoy playing golf. Naturally, the score is improved.

The stroke correcting device of the present invention can correct the stroke regardless of whether a player is right-handed or left-handed.

In addition, the stroke correcting device of the present invention can be shaped as desired by simple screwing with hands, so that the device can readily be worn by players of all ages as well as amateur and professional golfers.

The stroke correcting device of the present invention can be folded for example to be carried readily, and thus the device can be carried to any practice space where a player can appropriately practice strokes at any time and in any place.

Moreover, the practice is repeated while the golf club and the body of a player are fixed and accordingly the player can physically acquire a sense of correct stroke and induce sensitivity to putting or approach shot in playing golf. In this way, the player can make a correct stroke of a putting or approach shot.

INDUSTRIAL APPLICABILITY

The present invention is effectively applicable to golf practice devices and methods.

What is claimed is:

1. A stroke correcting device comprising an arm device provided with a plurality of arm pads attached thereto and a golf club fixing device, wherein the stroke correcting device is substantially pentagon in shape when the arm device is in an operating position; and wherein in the operating position, the arm device includes an upper-arm frame which is adapted to extend along the upper-arms of a player and a forearm frame adapted to extend along the forearms of the player.

2. The stroke correcting device according to claim 1, wherein the arm device and the golf club fixing device are integrated into a single unit.

3. The stroke correcting device according to claim 1, wherein the golf club fixing device fixes a putter golf club or an iron golf club to the arm device.

4. The stroke correcting device according to claim 1, wherein the arm device includes an elbow-to-elbow distance adjusting component having the function of reinforcing the arm device and adjusting the distance between the right and left elbows of a player.

5. The stroke correcting device according to claim 1, wherein said arm device has the function of adjusting the distance between the right and left arms of a player in training the function of adjusting the respective lengths of components according to the positional relationship between the right and left arms of the player; the function of adjusting respective angles of components of the arm device; the function of adjusting the angle formed by the arm device and the golf club fixing device (2) and the function of adjusting the angle formed by the arm device and the golf club.

6. A stroke correcting method using the stroke correcting device of claim 1, wherein the method steps comprise executing the stroke in a state in which the forearms and uppers arms of a player are supported by arm pads and a golf club and the arm pads are integrated into a single unit to allow the player to take a position which the player desires to assume.

7. A stroke correcting device comprising an arm device provided with a plurality of arm pads attached thereto, and a golf club fixing device, wherein the stroke correcting device has a configuration that is substantially pentagon in shape when the arm device is in an operating position, said arm device including an upper-arm frame which is adapted to extend along upper arms of a player in training and a forearm frame adapted to extend along forearms of the player of the player, said arm device further including a forward-tilt angle adjusting screw and a slide guide hole for adjusting a forward-tilt angle (β) of a coupling portion between said upper-arm frame and said forearm frame for adjusting respective lengths of components along the arms of the player according to the respective lengths of the right arm and the left arm of the player.

8. A stroke correcting device comprising an arm device provided with a plurality of arm pads attached thereto, and a golf club fixing device, wherein the stroke correcting device has a configuration that is substantially pentagon in shape when the arm device is in an operating position, said arm pads including an arm portion having a hollowed portion adapted to extend from an upper arm to a forearm of a player and adapted to receive said upper arm and the forearm, said arm portion having an upper-arm portion adapted to extend along the upper arm of the player, a forearm portion adapted to extend along the forearm of the player, and a bent portion adapted to be disposed between the upper-arm portion and the forearm portion, said bent portion being variably adjustable.

* * * * *